US007497527B2

(12) United States Patent
Fahrenbach

(10) Patent No.: US 7,497,527 B2
(45) Date of Patent: Mar. 3, 2009

(54) RESHAPING DEVICE WITH EJECTOR AND METHOD OF EJECTING WORKPIECES

(75) Inventor: Jürgen Fahrenbach, Aichelberg (DE)

(73) Assignee: Schuler Pressen GmbH & Co. KG, Göppingen (DE)

( * ) Notice: Subject to any disclaimer, the term of this patent is extended or adjusted under 35 U.S.C. 154(b) by 406 days.

(21) Appl. No.: 11/199,381

(22) Filed: Aug. 9, 2005

(65) Prior Publication Data

US 2006/0028061 A1 Feb. 9, 2006

(30) Foreign Application Priority Data

Aug. 9, 2004 (DE) ..... 10 2004 038 796
Aug. 3, 2005 (DE) ..... 10 2005 036 775

(51) Int. Cl.
*B60T 8/42* (2006.01)

(52) U.S. Cl. ..... 303/115.1; 72/169; 100/218

(58) Field of Classification Search ..... 303/115.1; 72/134, 208, 169, 328, 344–346, 351, 361, 72/414, 419, 426, 427; 83/129, 130, 132, 83/136–138, 142, 145; 100/218
See application file for complete search history.

(56) References Cited

U.S. PATENT DOCUMENTS 3,157,111 A * 11/1964 Andersen ..... 100/218
3,295,351 A * 1/1967 Jacobs ..... 72/344
4,006,655 A * 2/1977 Maurer ..... 83/63
5,778,721 A * 7/1998 Klingel et al. ..... 72/335

FOREIGN PATENT DOCUMENTS

WO WO 87/06165 10/1987

* cited by examiner

*Primary Examiner*—Pam Rodriguez
(74) *Attorney, Agent, or Firm*—Fitch, Even, Tabin & Flannery; Norman N. Kunitz

(57) ABSTRACT

A reshaping device according to the invention has at least one ejector, for example, in the form of a cylinder pin (11) which is shifted by the workpiece (6) against the pressure from a pressure storing cylinder (17) or other suitable energy storing device before and/or during the reshaping of the workpiece (6). The workpiece ejection occurs by the work stored in the energy storing device.

9 Claims, 5 Drawing Sheets

RESHAPING DEVICE WITH EJECTOR AND METHOD OF EJECTING WORKPIECES

CROSS REFERENCE TO RELATED APPLICATION

This application claims the priority of German Patent Application No. 10 2004 038 796.6, filed on Aug. 9, 2004, and of German Patent Application No. 10 2005 036 775.5, filed on Aug. 3, 2005, the subject matter of which, in its entirety, is incorporated herein by reference.

FIELD OF THE INVENTION

The invention relates to a reshaping device for reshaping, particularly for a massive reshaping, of workpieces and further relates to a method of ejecting workpieces from a matrix.

BACKGROUND OF THE INVENTION

Ejecting devices are known which form part of a reshaping tool. They are conventionally disposed in the lower tool and comprise one or more pins which are movable by mechanical or hydraulic drives. The ejecting devices serve for lifting the workpiece out of the lower tool subsequent to reshaping, so that the workpiece may be grasped and transported away by a transferring device.

The active drive of such ejecting pins is relatively expensive. In case a separate driving device is provided for the ejector, the energy required thereby is not insubstantial.

It is therefore an object of the invention to provide a device and a method by means of which workpieces may be guided out of a tool in a reliable manner and which avoid the above-noted disadvantages.

SUMMARY OF THE INVENTION

The ejecting system according to the invention, is a passive ejecting system which derives its energy from the motion of the reshaping device, particularly from the motion of the plunger or ram of the reshaping device. A displaceable matrix part is movable by the blank or a workpiece to be reshaped when the latter is pressed into the matrix by the plunger. Such a motion occurs against the force from an energy storing device, such as a pressure storing cylinder. The latter preferably has a piston which separates a work chamber filled with hydraulic fluid from a work chamber in which gas pressure prevails. The hydraulic fluid communicates with the hydraulic cylinder of the ejector. Instead of a gas cushion in the pressure storing cylinder, a different force-generating means, such as a compression spring or the like may be provided. The work transferred to the energy storing device during the downward motion of the ram or plunger is utilized for lifting the workpiece out of the matrix during the upward stroke of the ram or plunger. During such a step the workpiece is preferably lifted to the height of a transporting plane of a transferring device, for example, a jaw-type transferring device. During the upward stroke of the plunger, the workpiece moves synchronously with the plunger from the matrix until the workpiece has reached the transporting plane. The movable matrix part, serving as the ejector, stops at that location.

Preferably, the hydraulic cylinder is connected to a pressure storing cylinder, whose absorption capacity is slightly less than the volume of the hydraulic fluid displaced during a working stroke. In this manner the pressure storing cylinder constitutes a more or less fixed abutment for the movable matrix part. If, with the first pressure storing cylinder a second pressure storing cylinder is connected parallel which, for example, is set to a higher hydraulic pressure level, such second pressure storing cylinder forms a yielding abutment for the movable matrix part. The pressure storing cylinder having the higher pressure level may thus serve as an elastic terminal abutment for the movable matrix part or may also serve to build up a counter pressure for the flowing workpiece during a reshaping process. Further, the pressure storing cylinder in which the higher pressure prevails may serve as an overload safety.

Preferably, the absorption capacity of the pressure storing cylinder, at least that of the pressure storing cylinder in which the lower pressure prevails, may be varied, that is, it may be adjustable by a setting device. In this manner the ejecting stroke traveled by the matrix part may be adjusted. Such a property may be used for a readjustment of the ejector height and thus for a readjustment of the transporting plane of the workpieces.

Preferably, between the hydraulic cylinder and at least one pressure storing cylinder a valve block is provided which may affect the hydraulic flow between the two cylinders. It is feasible to provide at least one flow-through position and a throttling position to allow, for example, an unthrottled flow of the hydraulic fluid from the hydraulic cylinder to the pressure storing cylinder during the reshaping process. The counter pressure exerted by the movable matrix part is thus determined solely by the pressure prevailing in the pressure storing cylinder. During the return stroke the hydraulic flow may be throttled for limiting the ejecting speed.

It is also feasible to completely shut off the hydraulic flow for arresting the matrix part.

Preferably, at least one pressure storing cylinder is provided with a terminal-location damping arrangement. The terminal-location damping arrangement provides for a slowdown and soft braking of the piston of the pressure storing cylinder and thus for the braking of the hydraulic flow shortly before reaching the terminal position. In this manner the ejector discontinues its ejecting stroke gradually, rather than abruptly. As a result, a clean transfer of the workpiece between the ejector and the transferring device is made possible.

Preferably, at least one pressure storing cylinder is provided with a displacement sensor which, for example, recognizes when the end position of the of the piston of the pressure storing cylinder is reached. The signal thus obtained may serve as a synchronization signal for the transferring device to alert the latter that the workpiece has reached its desired transfer position. For this purpose a suitable control device may be provided.

Further, such a control device, or a separately provided control device may serve to monitor the pressure in the pressure storing cylinder and to regulate the same in a constant or predetermined manner or according to a timing profile for thus setting the ejecting force in a controlled manner.

Further details of advantageous embodiments of the invention are disclosed in the dependent claims, the drawing or the ensuing description.

DETAILED DESCRIPTION OF THE INVENTION

Figure 1:
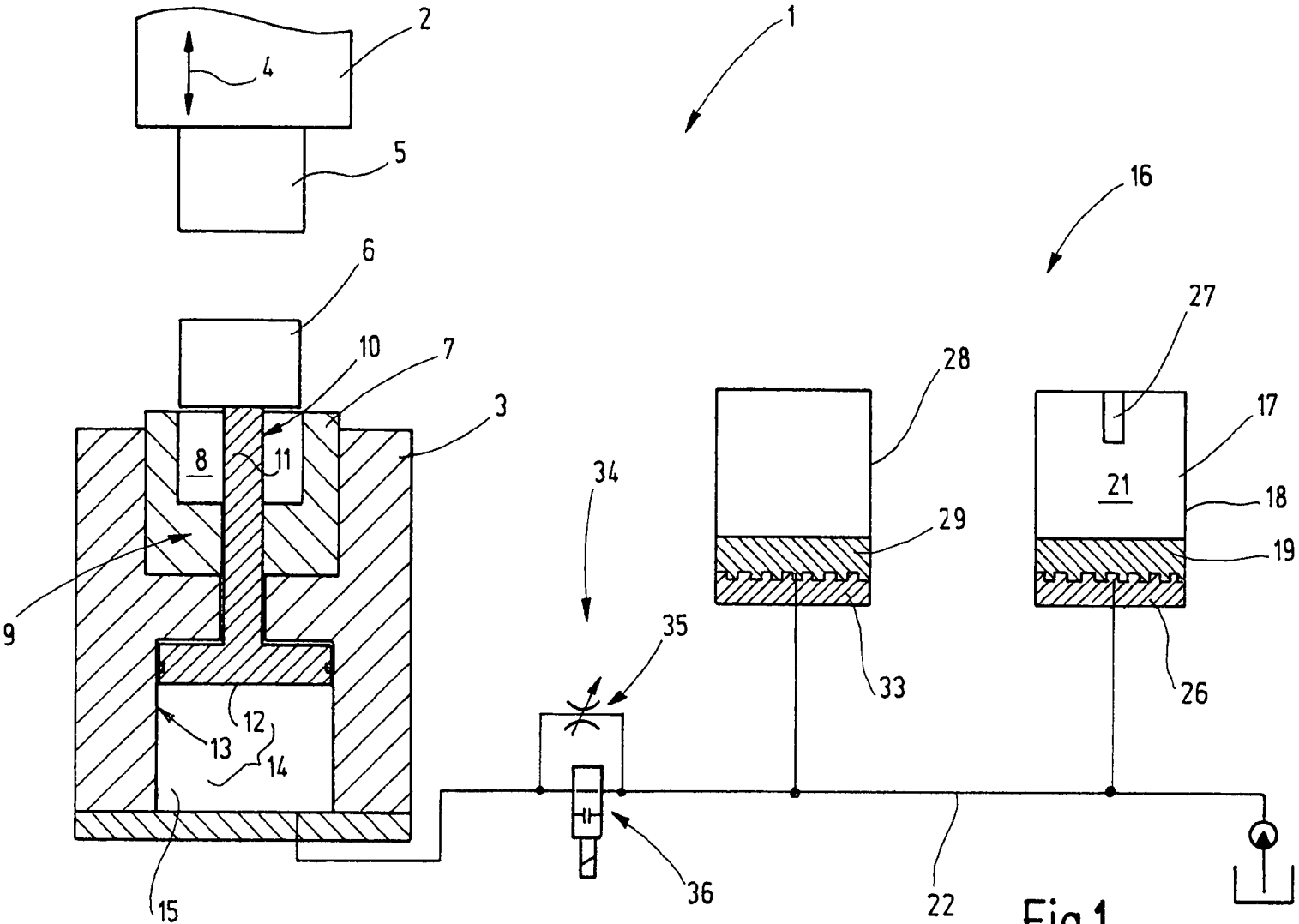
FIG. 1 is a schematic illustration of essential functional elements of the reshaping device according to the invention, prior to positioning a workpiece into the matrix.

FIG. 1 schematically illustrates a reshaping device 1 which includes a press not shown in further detail. The press has a plunger 2 movable, for example, vertically up and down and a tool stand 3 stationarily supported in the press stand. The direction of motion of the plunger 2 is shown by an arrow 4 in FIG. 1. The plunger 2 carries a ram 5 for reshaping a workpiece 6 which is shown as a blank in FIG. 1.

In the tool stand 3 a matrix 7 is supported which may also be designated as a swage and which has an engraving 8 for reshaping the workpiece 6 therein.

The matrix 7 and the tool stand 3 are provided with an ejecting device 9 which has one or several ejectors. The ejectors may be in each instance formed as a movable matrix part 10, shaped, for example, as a slender cylinder. In the present embodiment the movable matrix part 10 is a cylinder pin 11 having a cylindrical circumferential surface and a planar end face. Particularly the shape of the end face may be arbitrarily selected within wide limits.

The cylinder pin 11 is connected with a piston 12 supported in a sealed manner in a cylindrical bore 13 and displaceable in the longitudinal direction of the cylinder pin 11. The bore 13 is formed in the tool stand 3 or in a separate cylinder body connected with the tool stand 3 and arranged underneath the matrix 7. The bore 13 functionally forms, together with the piston 12, a hydraulic cylinder 14, whose work chamber 15 is filled with a hydraulic fluid.

To the work chamber 15 a passive hydraulic system 16 is connected which comprises at least one pressure storing cylinder 17. The latter includes a piston 19 which is slidably supported in a cylinder 18 and which, as seen particularly in FIG. 2, separates two work chambers 20 and 21 from one another. Both work chambers are hermetically sealed outward. While the work chamber 20 is filled with a hydraulic fluid and communicates with the work chamber 15 of the hydraulic cylinder 14 by means of a conduit 22, the work chamber 21 is filled with a gas and thus presents, for example, a nitrogen cushion having a determined pressure.

The piston 19 is preferably provided with a terminal-position damping device 23 which is constituted, for example, by a suitable concentric or parallel web profile 24 provided on that side of the piston 19 which is oriented toward the work chamber 20, as well as by a profile 25 which is provided on a facing closure member 26 and which conforms to the profile 24.

Further, the pressure storing cylinder 17 is preferably provided with a setting device 27 for limiting the stroke of the piston 19. The setting device 27 forms, for example, an adjustable upper abutment for establishing a minimum volume for the work chamber 21, as well as a maximum volume for the work chamber 20.

Instead of a pressure storing cylinder, a pressure storing device without the piston 19 may be provided in which a gas cushion and the hydraulic fluid directly contact one another or are separated from one another by a diaphragm.

To the conduit 22 preferably a further pressure storing cylinder 28 is coupled, whose basic construction corresponds to that of the pressure storing cylinder 17. A setting device for limiting the piston stroke may be dispensed with. Further, the pressure storing cylinder 28 may have a lesser absorption capacity and may have dimensions other than those of the pressure storing cylinder 17. Again, the piston 29 of the pressure storing cylinder 28 is provided with a terminal-position damping device 30 which is formed by conforming profiles 31, 32 on the piston 29 and the facing closure member 33.

The pressure storing cylinder 28 too, contains a volume of pressurized gas which charges the piston 29 with pressure from above, while the piston 29 is in contact with the hydraulic fluid from below. The pressure level of the pressure storing cylinder 28 is preferably significantly greater than that prevailing in the pressure storing cylinder 17. The pressure storing cylinder 28 does not need a piston 29 if a direct contact between the gas cushion and the hydraulic fluid is permissible. In the alternative, the piston 29 may be replaced by a diaphragm.

The communication between the hydraulic cylinder 14 and the pressure storing cylinders 17, 28 is controlled by a valve block 34 disposed in the conduit 22. The valve block 34 contains, for example, an adjustable throttle 35 and a distributing valve 36 which is connected parallel with the throttle 35. The valve block 34 is, for example, by means of an electric control, switchable between two positions, one of which being a flow-through position, while the other may be a shut-off position.

Figure 5:
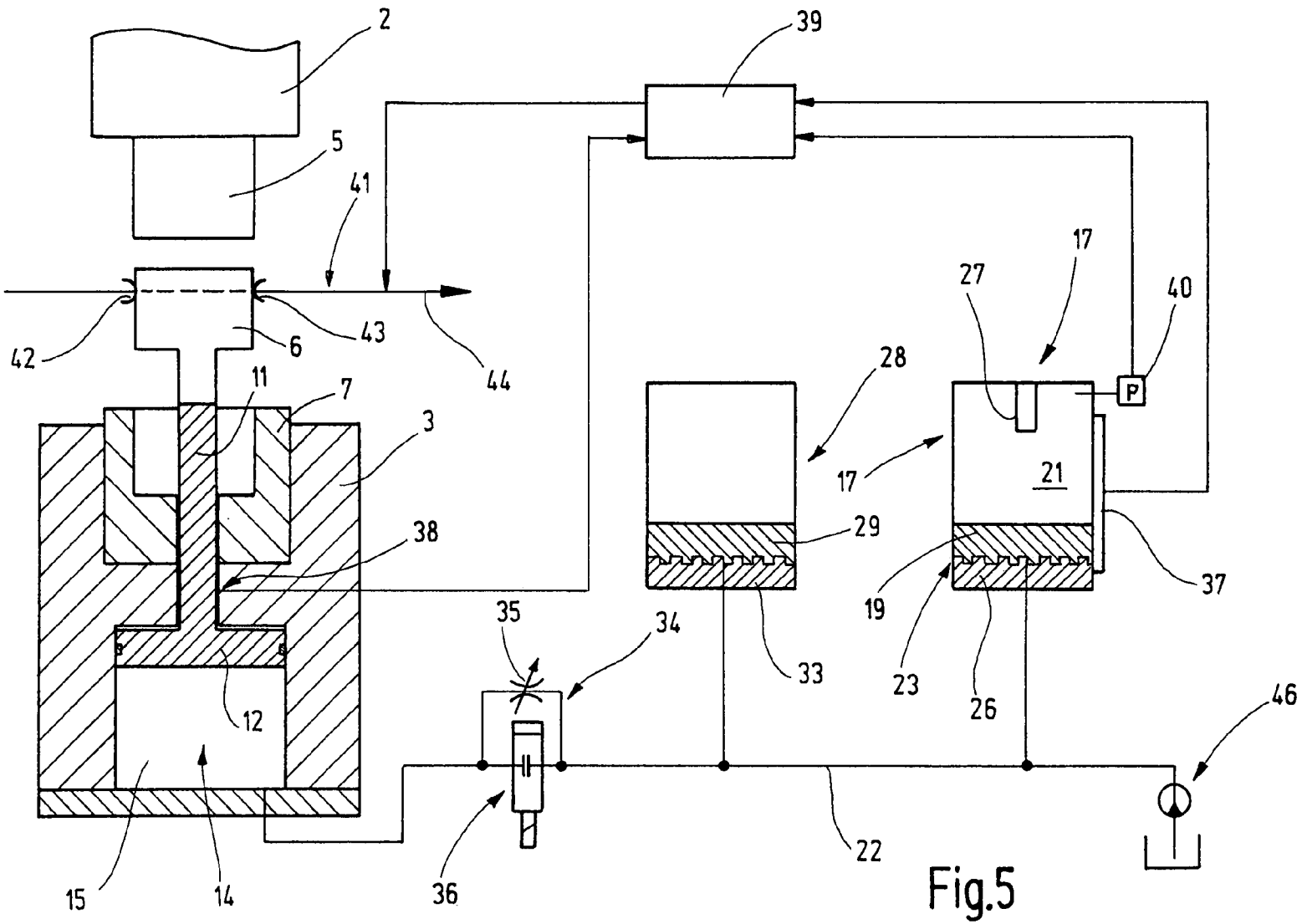
FIG. 5 shows the reshaping device together with a reshaped workpiece lifted to the transporting plane and further shows control and monitoring means associated with the reshaping device.

As shown schematically in FIG. 5, the pressure storing cylinder 17 may be provided with a displacement sensor 37 which detects the position of the piston 19 at least in selected positions. In addition, or as an alternative, a limit switch or a displacement sensor 38 may be arranged in such a manner that it detects the position of the cylinder pin 11. The displacement sensors 37, 38 are connected with a control device 39 which may also be coupled with the distributor valve 36 of the valve block 34. Further, the control device 39 may monitor the pressure in the work chamber 21 of the pressure storing cylinder 17 by means of as pressure sensor 40. Further, the control device 39 may serve for controlling a transferring device 41 which is highly schematically illustrated in FIG. 5 and which grasps the workpiece 6, for example, by means of two schematically shown jaws 42, 43 for transporting the workpiece to a subsequent reshaping station. Such a conveyance occurs, for example, along a linear path, that is, the lower end face of the workpiece 6 runs on a plane. The transporting direction which is designated by an arrow 44 in FIG. 5, may be, for example, perpendicular to the plane of FIG. 5. The transferring device 41 is controlled, or at least synchronized, by the control device 39. In this manner it is ensured that the workpiece 6 is transported only after it is entirely taken out of the matrix 7.

The reshaping device 1 described so far operates as follows:

For performing a reshaping of the workpiece 6, the latter is first placed above the matrix 7 by the transfer device not shown in detail in FIG. 1, and is then set on the end face of the cylinder pin 11. The ram 5 is thereafter moved by the plunger 2 toward the workpiece 6 and presses the latter into the engraving 8 of the matrix 7. During this occurrence the workpiece 6 presses the cylinder pin 11 and thus the piston 12 downward, whereby the volume of the work chamber 15 is reduced. At this point in time the distributor valve 36 is in its flow-through position. The hydraulic fluid displaced by the piston 12 flows through the conduit 22 to the pressure storing cylinders 17, 28. The pressure storing cylinder 17 which is under low pressure, receives the hydraulic fluid which pushes the piston 19, still dwelling on the closure member 26, away from the closure member 26, as a result of which the work chamber 20 is filled with hydraulic fluid.

Figure 2:
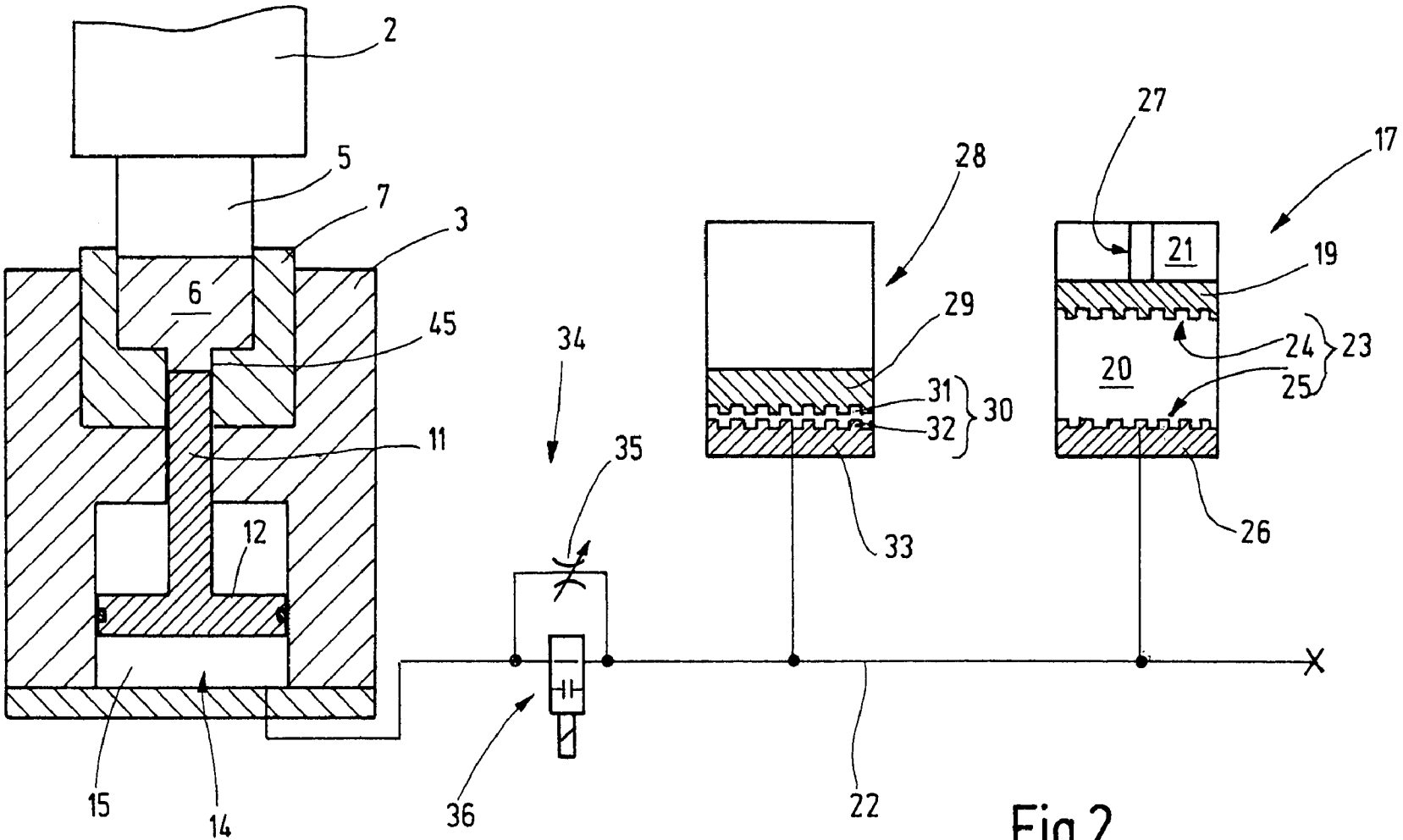
FIG. 2 shows the reshaping device of FIG. 1 upon conclusion of a first stage of the reshaping process.

When the workpiece 6, as shown in FIG. 2, is pressed entirely into the engraving of the matrix 7, and the ram 5 moves further into the matrix 7, a reshaping of the workpiece 6 takes place. In FIG. 2 the beginning of the reshaping is depicted, during which the material of the workpiece 6 flows into a passage bore 45, through which the cylinder pin 11 extended previously. Thus, the latter is displaced not only from the engraving 8, but, at least partially, also from the passage bore 45. This occurs against a relatively small resistance, as long as the work chamber 20 of the pressure storing cylinder 17 may continue to increase and to be filled with hydraulic fluid. When, however, the piston 19 reaches the abutment of the setting device 27, the absorption capacity of the pressure storing cylinder 17 has been fully exhausted. In case the reshaping of the workpiece 6 is not fully completed at this point in time, the piston 12 may displace additional hydraulic fluid which then flows into the pressure storing cylinder 28 which opposes the admission of hydraulic fluid with a higher counter pressure.

Figure 3:
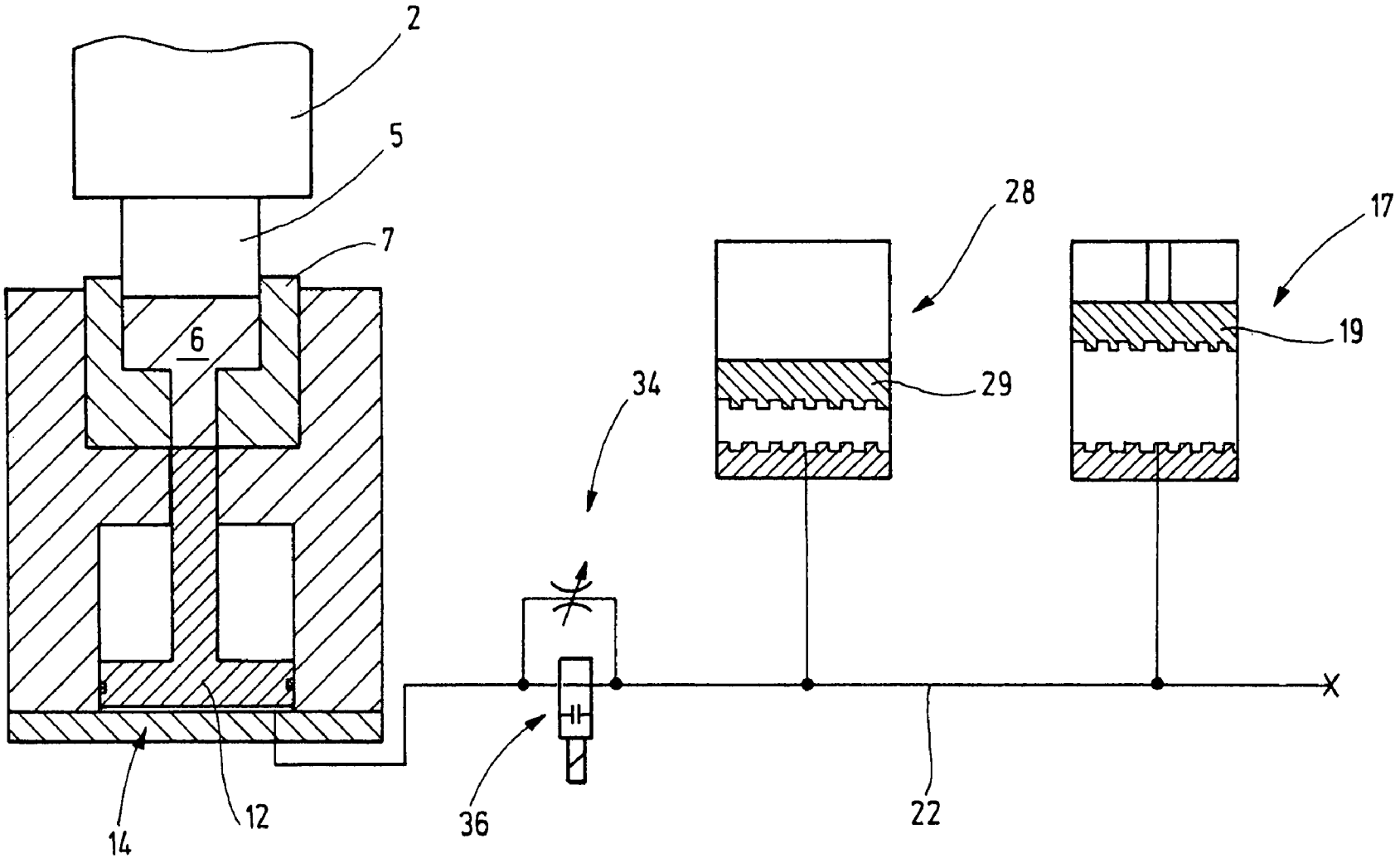
FIG. 3 shows the reshaping device of FIG. 1 upon conclusion of the reshaping process.

The higher counter pressure of the pressure storing cylinder 28 thus abruptly increases the fluid pressure in the work chamber 15, and the cylinder pin 11 opposes the displacement of the material of the workpiece 6 with a significantly greater resistance than before. In this manner a higher counter pressure is generated which affects the end face of the cylinder pin 11 and which may be utilized, for example, for obtaining a certain desired workpiece quality as a result of the reshaping process. When the reshaping process is completed, the state shown, for example, in FIG. 3 is obtained: The ram 5 has reached its lower dead center; the workpiece 6 is fully reshaped; the cylinder pin 11 has been partially or fully moved out of the passage bore 45 of the matrix 7; both pressure storing cylinders 17, 28 have received the hydraulic fluid displaced by the piston 12; and in the entire hydraulic system the higher pressure prevails, as determined by the pressure storing cylinder 28.

Figure 4:
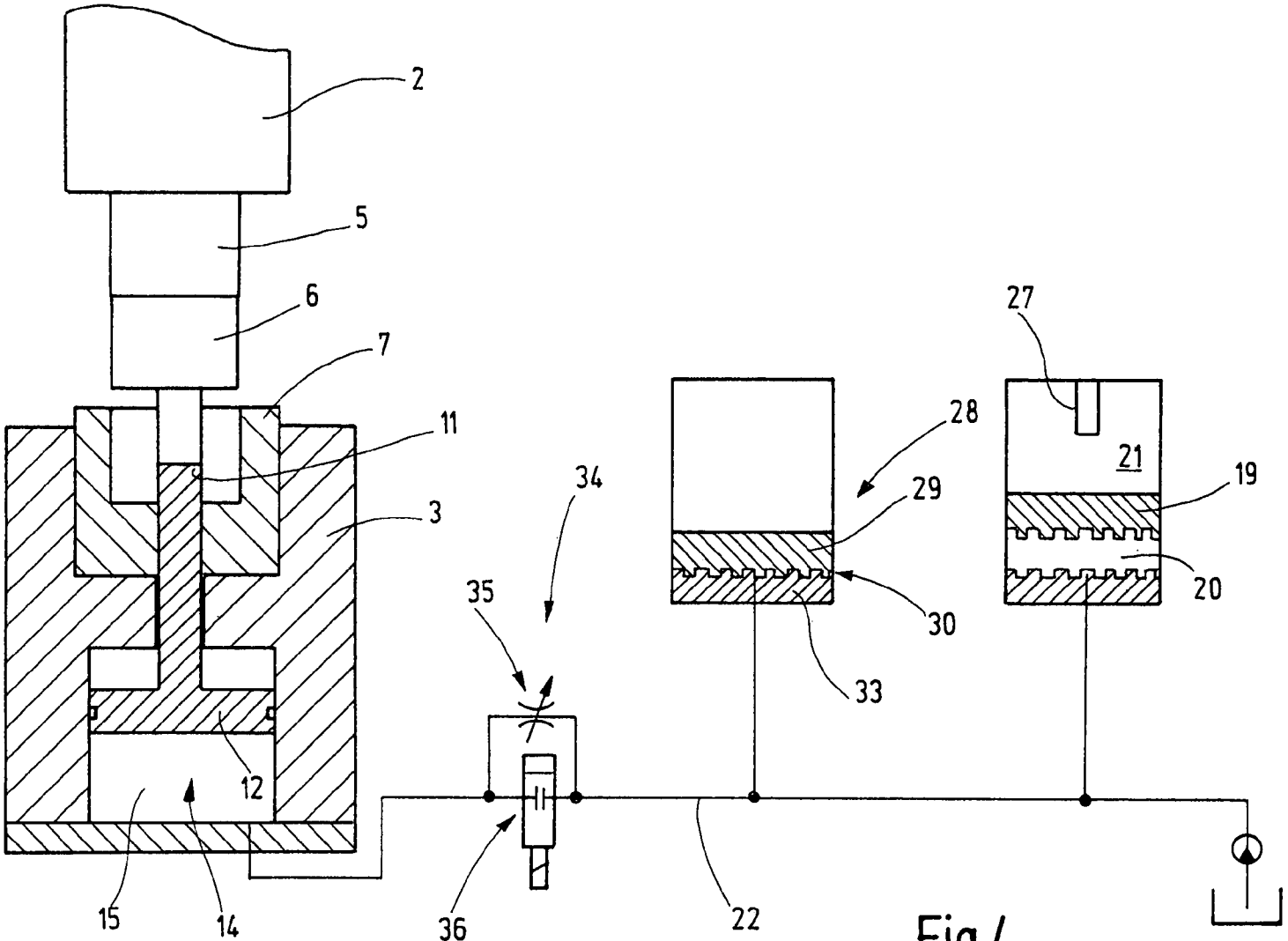
FIG. 4 shows the reshaping device of FIG. 1 during the ejecting stroke.

As shown in FIG. 4, the upward stroke of the plunger 2 starts from the above-described state. For this purpose, the valve block 34, which up to now was in its flow-through position, is switched, so that the distributor valve 36 closes. Merely the fixed or variable throttle 35 allows a hydraulic flow. According to a particularly convenient embodiment, the throttle 35 may be controlled by the control device 39. The hydraulic fluid first flows through the throttle 35 or, in some cases, through the still-open distributor valve 36 from the pressure storing cylinder 28 through the conduit 22 back into the work chamber 15 of the hydraulic cylinder 14 and, while doing so, shifts the piston 12 and the cylinder pin 11 upward, in the direction of motion of the plunger 2. As long as such a motion is caused by the flow from the pressure storing cylinder 28, the moving force is large. After a relatively short travel, the terminal-position damping device 30 becomes active and brakes the piston 29 before it sets on the closure member 33. At that moment the piston 19 separates from the abutment formed by the setting device 27 and travels downward under the effect of the gas cushion present in the work chamber 21. In this manner the piston 19 displaces hydraulic fluid from the work chamber 20 and thus shifts the piston 12 further upward. As a result, the workpiece 6 continues to be pressed against the ram 5 and travels upward in synchronism therewith.

As soon as the piston 19 approaches the closure member 26 to such an extent that the terminal-position damping device 23 is activated, the piston 19 is braked. As a result, the ram 5 lifts off the workpiece 6 and travels without it further upward. The piston 19 reaches its end position in which it lifted the workpiece 6 into the transporting plane. The attainment of the end position of the piston 19 may be detected by the displacement sensor 37 or additionally, or in the alternative, by the displacement sensor 38 and reported to the control device 39. The latter then may trigger the operation of the transferring device 41 or may send a synchronizing signal thereto. The jaws 42, 43 grasp the workpiece 6 and convey it away from the matrix 7. The described operational cycle may then start anew with a workpiece 6 according to FIG. 1.

During the entire process or merely from time to time, the control device 39 may monitor the pressure in the pressure storing cylinder 17 and, if needed, also in the pressure storing cylinder 28, and may accordingly readjust such pressures by a device not shown.

Further, a pump 46, coupled with the conduit 22, may replenish the hydraulic system as required. This makes it feasible to regulate, by the setting device 27, the magnitude of the ejecting stroke, that is, the stroke of the cylinder pin 11 and thus to regulate the height to which the workpiece 6 is raised after reshaping.

In recapitulation, the following principal points may be summarized: The ram 5 driven by the plunger 2 shifts the workpiece 6 against one or more pre-pressurized hydraulic cylinders 14 which are pre-pressurized by one or more pressure storing cylinders 17 to the same or different pressures. During reshaping, the hydraulic cylinder 14 simultaneously serves as a counter-supporting cylinder. By means of parallel-connected high-pressure and low-pressure storing cylinders 28, 17 or hydro-storing devices having a terminal-position damping means and inner abutments in the hydro-storing devices, the completed workpiece is ejected onto the transporting plane of the jaw-type conveying device. Upon the release and the return stroke of the plunger 2, the workpiece 6 travels in synchronism with the plunger 2 from the matrix 7 until the workpiece 6 has reached the transporting plane. After reaching the transporting plane, the piston 19 of the low-pressure storing cylinder 17 and the piston 29 of the high-pressure storing cylinder 28 are in the respective terminal-position damping range 23, 30. The low-pressure storing cylinder 17 has a variable piston abutment 27. As a result of the adjustability of the piston abutment 27, the transporting plane may be readjusted. The adjustability of the piston abutment 27 advantageously results in the variability of the system. The nitrogen bias determines the ejecting force and may simultaneously serve as an overload safety. Control of the synchronization may be effected by the displacement sensors 37, 38 which make possible the monitoring of the transport synchronization. Hydraulic supply preferably occurs by means of air-hydraulic pumps. The bias pressure is supervised by a pressure monitoring device, for example, a pressure sensor 40 and the control device 39. In case of an excessive, pressure-caused forward flow displacement, the backflow may be controlled by a quantity regulator or distributing valves.

A reshaping device according to the invention has at least one ejector, for example, in the form of a cylinder pin 11 which is shifted by the workpiece 6 against the pressure from a pressure storing cylinder 17 or other suitable energy storing device before and/or during the reshaping of the workpiece 6. The workpiece ejection occurs by the work stored in the energy storing device.

It will be appreciated that the above description of the present invention is susceptible to various modifications, changes and adaptations, and the same are intended to be comprehended within the meaning and range of equivalents of the appended claims.

What is claimed is:

1. A reshaping device for massive reshaping of workpieces, comprising:

a matrix having a movably supported matrix part for ejecting a workpiece, a plunger with a ram associated with the matrix for reshaping the workpiece with the plunger being movable in a direction of plunger movement for moving the ram toward and away from the matrix and for moving the matrix part during a working stroke of the plunger;

at least one hydraulic cylinder whose piston is connected with the matrix part for movement therewith, and a passive hydraulic system connected to the hydraulic cylinder and including at least one first pressure storing cylinder, whose inner pressure is preset at a first pressure level and which is connected with the hydraulic cylinder, and at least one second pressure storing cylinder whose inner pressure is preset at a second pressure level which is higher than the pressure level of the first pressure storing cylinder, whereby hydraulic fluid displaced from the hydraulic cylinder during the working stroke of said plunger flows into said pressure storing cylinders, and flows back into the hydraulic cylinder during a return stroke of the plunger.

2. The reshaping device as defined in claim 1, wherein the first pressure storing cylinder has an absorption capacity which is less than the volume of the hydraulic fluid displaced during a working stroke of the hydraulic cylinder.

3. The reshaping device as defined in claim 2, wherein the absorption capacity of the first pressure storing cylinder is adjustable by a setting device.

4. The reshaping device as defined in claim 1, wherein the movably supported matrix part has a stroke which is at least as large as the depth of the matrix measured in the direction of plunger movement.

5. The reshaping device as defined in claim 1, wherein a valve block is arranged between the pressure storing cylinders and the hydraulic cylinder.

6. The reshaping device as defined in claim 5, wherein the valve block allows, in at least in one first position, a free hydraulic flow between the hydraulic cylinder and the pressure storing cylinders.

7. The reshaping device as defined in claim 5, wherein the valve block throttles, in at least in one second position, the hydraulic flow between the hydraulic cylinder and the pressure storing cylinders.

8. The reshaping device as defined in claim 5, wherein the valve block prevents, in at least in one second position, the hydraulic flow between the hydraulic cylinder and the pressure storing cylinders.

9. The reshaping device as defined in claim 1, wherein at least one of the first and second pressure storing cylinders is provided with a terminal-position damping device.

* * * * *